US007944406B2

(12) United States Patent
Moon

(10) Patent No.: US 7,944,406 B2
(45) Date of Patent: May 17, 2011

(54) METHOD OF DRIVING PLASMA DISPLAY APPARATUS

(75) Inventor: Seonghak Moon, Seoul (KR)

(73) Assignee: LG Electronics Inc., Seoul (KR)

( * ) Notice: Subject to any disclaimer, the term of this patent is extended or adjusted under 35 U.S.C. 154(b) by 783 days.

(21) Appl. No.: 11/947,659

(22) Filed: Nov. 29, 2007

(65) Prior Publication Data

US 2008/0122744 A1 May 29, 2008

(30) Foreign Application Priority Data

Nov. 29, 2006 (KR) ..... 10-2006-0119390

(51) Int. Cl.
*G09G 3/28* (2006.01)

(52) U.S. Cl. ..... 345/60; 345/204

(58) Field of Classification Search ..... 345/60–72, 345/204, 690–692; 315/169.4
See application file for complete search history.

(56) References Cited

U.S. PATENT DOCUMENTS

| | | | | |
|---|---|---|---|---|
| 6,072,447 | A * | 6/2000 | Noborio | 345/60 |
| 7,102,596 | B2 * | 9/2006 | Kang et al. | 345/60 |
| 7,542,014 | B2 * | 6/2009 | Kim | 345/60 |
| 2005/0225510 | A1 * | 10/2005 | Ito et al. | 345/60 |

FOREIGN PATENT DOCUMENTS

| | | |
|---|---|---|
| KR | 10-2005-0078452 | 8/2005 |
| KR | 10-2005-0099703 | 10/2005 |

* cited by examiner

*Primary Examiner* — Stephen G Sherman
(74) *Attorney, Agent, or Firm* — Fish & Richardson P.C.

(57) ABSTRACT

A method of driving a plasma display apparatus is disclosed. The method includes supplying a first scan signal to a first scan electrode group of a plurality of scan electrode groups each including at least one scan electrode during an address period, supplying a second scan signal having a different voltage magnitude from a voltage magnitude of the first scan signal to a second scan electrode group of the plurality of scan electrode groups during the address period, and supplying a data signal corresponding to the first scan signal and the second scan signal to an address electrode. The first scan signal or the second scan signal is supplied depending on scanning order of the plurality of scan electrodes during the address period.

24 Claims, 9 Drawing Sheets

METHOD OF DRIVING PLASMA DISPLAY APPARATUS

This application claims the benefit of Korean Patent Application No. 10-2006-0119390 filed on Nov. 29, 2006, which is hereby incorporated by reference.

BACKGROUND OF THE DISCLOSURE

1. Field of the Disclosure

This document relates to a method of driving a plasma display apparatus.

2. Description of the Related Art

A plasma display apparatus includes a plasma display panel and a driver for driving the plasma display panel.

The plasma display panel has the structure in which barrier ribs formed between a front panel and a rear panel forms unit discharge cell or a plurality of discharge cells. Each discharge cell is filled with an inert gas containing a main discharge gas such as neon (Ne), helium (He) or a mixture of Ne and He, and a small amount of xenon (Xe). The plurality of discharge cells form one pixel. For example, a red (R) discharge cell, a green (G) discharge cell, and a blue (B) discharge cell form one pixel. When the plasma display panel is discharged by applying a high frequency voltage to the discharge cell, the inert gas generates vacuum ultraviolet rays, which thereby cause phosphors formed between the barrier ribs to emit light, thus displaying an image. Since the plasma display apparatus can be manufactured to be thin and light, it has attracted attention as a next generation display device.

SUMMARY OF THE DISCLOSURE

This document provides a method of driving a plasma display apparatus capable of increasing an address margin and a sustain margin.

This document provides a method of driving a plasma display apparatus capable of preventing an erroneous discharge by improving a driving margin at a high temperature and a low temperature.

In one aspect, a method of driving a plasma display apparatus comprises supplying a first scan signal to a first scan electrode group of a plurality of scan electrode groups each including at least one scan electrode during an address period, supplying a second scan signal having a different voltage magnitude from a voltage magnitude of the first scan signal to a second scan electrode group of the plurality of scan electrode groups during the address period, and supplying a data signal corresponding to the first scan signal and the second scan signal to an address electrode, wherein the first scan signal or the second scan signal is supplied depending on scanning order of the plurality of scan electrodes during the address period.

In another aspect, a method of driving a plasma display apparatus comprises supplying a first scan signal to a first scan electrode group of a plurality of scan electrode groups each including at least one scan electrode during an address period, supplying a second scan signal to a second scan electrode group of the plurality of scan electrode groups during the address period, supplying a first data signal corresponding to the first scan signal to a first address electrode group corresponding to the first scan electrode group during the address period, and supplying a second data signal corresponding to the second scan signal to a second address electrode group corresponding to the second scan electrode group during the address period, wherein a sum of a voltage magnitude of the first scan signal and a voltage magnitude of the first data signal is different from a sum of a voltage magnitude of the second scan signal and a voltage magnitude of the second data signal.

In yet another aspect, a method of driving a plasma display apparatus comprises supplying a first scan signal to a scan electrode during an address period of a first subfield of a plurality of subfields of one frame, supplying a second scan signal to the scan electrode during an address period of a second subfield of the plurality of subfields, supplying a first data signal corresponding to the first scan signal supplied during the address period of the first subfield or corresponding to the second scan signal supplied during the address period of the second subfield to a first address electrode group of a plurality of address electrode groups each including at least one address electrode, and supplying a second data signal corresponding to the first scan signal supplied during the address period of the first subfield or corresponding to the second scan signal supplied during the address period of the second subfield to a second address electrode group of the plurality of address electrode groups, wherein a sum of a voltage magnitude of the first scan signal and a voltage magnitude of the first data signal is different from a sum of a voltage magnitude of the second scan signal and a voltage magnitude of the second data signal, and a sum of the voltage magnitude of the second scan signal and the voltage magnitude of the first data signal is different from a sum of the voltage magnitude of the first scan signal and the voltage magnitude of the second data signal.

BRIEF DESCRIPTION OF THE DRAWINGS

The accompanying drawings, which are included to provide a further understanding of the invention and are incorporated on and constitute a part of this specification, illustrate embodiments of the invention and together with the description serve to explain the principles of the invention. In the drawings.

DETAILED DESCRIPTION OF EMBODIMENTS

Reference will now be made in detail embodiments of the invention examples of which are illustrated in the accompanying drawings.

Figure 1:
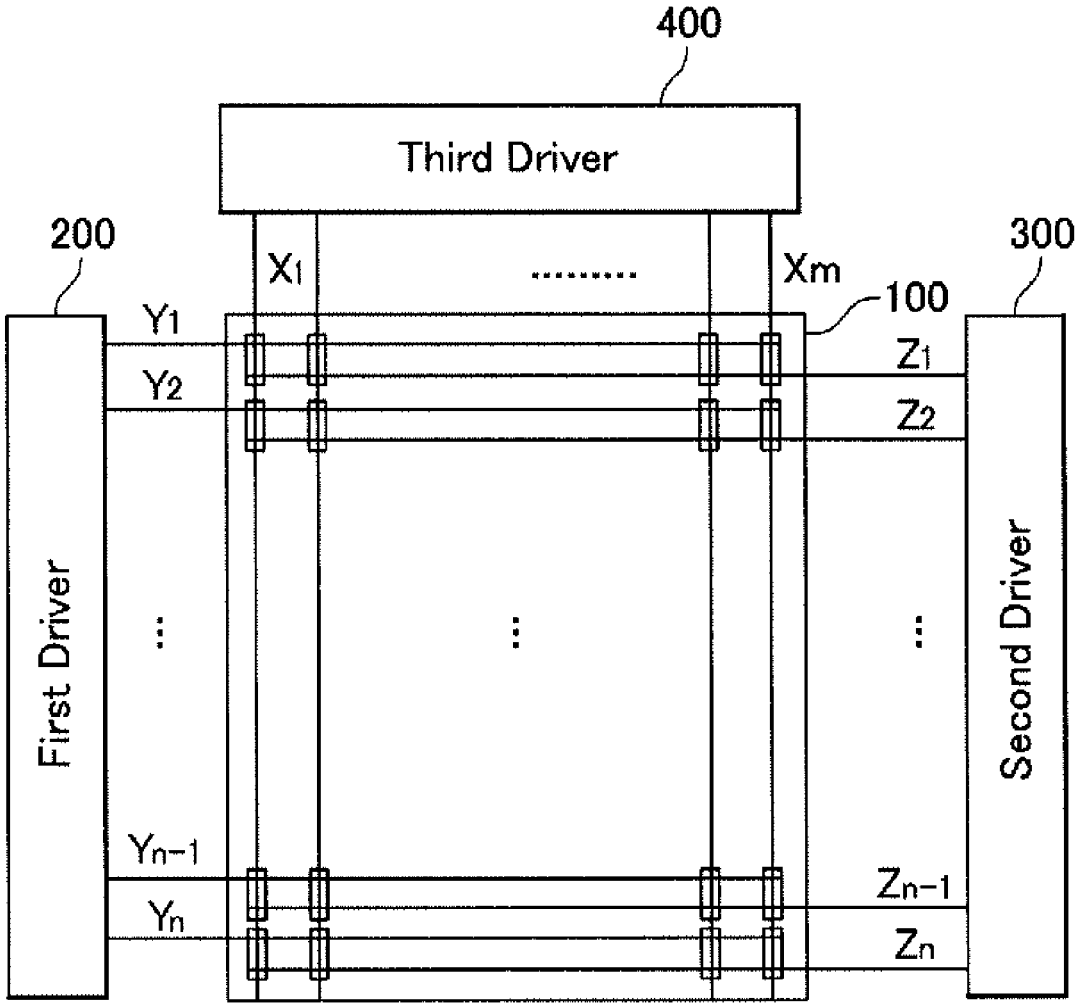
FIG. 1 shows a plasma display apparatus according to an exemplary embodiment.

FIG. 1 shows a plasma display apparatus according to an exemplary embodiment.

As shown in FIG. 1, the plasma display apparatus according to the exemplary embodiment includes a plasma display panel 100, a first driver 200, a second driver 300, and a third driver 400.

The plasma display panel 100 includes a front panel (not shown) and a rear panel (not shown) which coalesce with each other at a given distance. The plasma display panel 100 includes scan electrodes Y1 to Yn, sustain electrodes Z1 to Zn, and address electrodes X1 to Xm.

The first driver 200 supplies a reset signal to the scan electrodes Y1 to Yn during a reset period to thereby accumulate uniformly wall charges inside discharge cells. The first driver 200 supplies a scan signal to the scan electrodes Y1 to Yn during an address period to thereby select the discharge cells to be turned on. The first driver 200 supplies a sustain signal to the scan electrodes Y1 to Yn during a sustain period to thereby generate a sustain discharge inside the selected discharge cell.

The first driver 200 may supply a scan signal having a different voltage magnitude during an address period of each subfield, or may supply a scan signal having a different voltage magnitude to each of a plurality of scan electrode groups each including at least one scan electrode.

The second driver 300 supplies a sustain bias signal to the sustain electrodes Z1 to Zn during a set-down period and the address period. The second driver 300 supplies a sustain signal to the sustain electrodes Z1 to Zn during the sustain period.

The third driver 400 receives data mapped for each subfield by a subfield mapping circuit (not shown) after being inverse-gamma corrected and error-diffused through an inverse gamma correction circuit (not shown) and an error diffusion circuit (not shown), or the like. The third driver 400 supplies a data signal corresponding to the scan signal to the address electrodes X1 to Xm in response to a data timing control signal received from a timing controller (not shown).

The third driver 400 may include into two drivers. The third driver 400 may supply data signals corresponding to the scan signals having the different voltage magnitudes supplied to the plurality of scan electrode groups. Accordingly, the third driver 400 (or the two drivers) may supply a data signal having a different voltage magnitude during an address period of each subfield.

Figure 2:
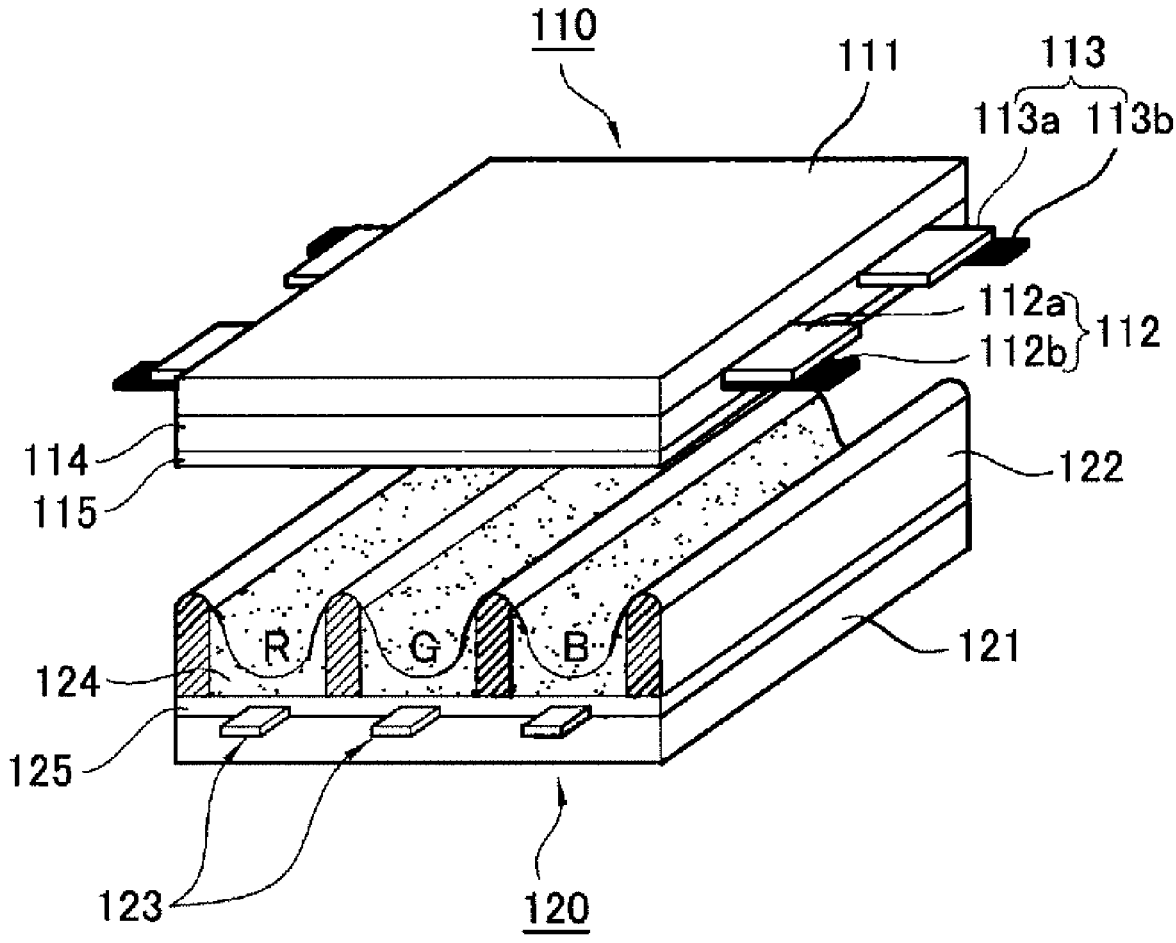
FIG. 2 shows a structure of a plasma display panel of the plasma display apparatus according to the exemplary embodiment.

FIG. 2 shows a structure of a plasma display panel of the plasma display apparatus according to the exemplary embodiment.

As shown in FIG. 2, the plasma display panel 100 includes a front panel 110 and a rear panel 120 which coalesce with each other at a given distance therebetween. The front panel 110 includes a front substrate 111 on which a scan electrode 112 and a sustain electrode 113 are positioned parallel to each other. The rear panel 120 includes a rear substrate 121 on which an address electrode 123 is positioned to intersect the scan electrode 112 and the sustain electrode 113.

The scan electrode 112 and the sustain electrode 113 generate a mutual discharge therebetween in a discharge cell and maintain a discharge of the discharge cell.

A light transmittance and an electrical conductivity of the scan electrode 112 and the sustain electrode 113 need to be considered so as to emit light produced inside the discharge cells to the outside and to secure the driving efficiency. Accordingly, the scan electrode 112 and the sustain electrode 113 each include transparent electrodes 112*a* and 113*a* made of a transparent material, e.g., indium-tin-oxide (ITO) and bus electrodes 112*b* and 113*b* made of a metal material such as silver (Ag).

An upper dielectric layer 114 covering the scan electrode 112 and the sustain electrode 113 is positioned on the front substrate 111 on which the scan electrode 112 and the sustain electrode 113 are positioned. The upper dielectric layer 114 limits discharge currents of the scan electrode 112 and the sustain electrode 113 and provides electrical insulation between the scan electrode 112 and the sustain electrode 113.

A protective layer 115 is positioned on an upper surface of the upper dielectric layer 114 to facilitate discharge conditions. The protective layer 115 may be formed of a material with a high secondary electron emission coefficient, e.g., magnesium oxide (MgO).

The address electrode 123 positioned on the rear substrate 121 applies a data signal to the discharge cell.

A lower dielectric layer 125 covering the address electrode 123 is positioned on the rear substrate 121 on which the address electrode 123 is positioned.

Barrier ribs 122 are positioned on the lower dielectric layer 125 to partition the discharge cells. A phosphor 124 emitting visible light for an image display during an address discharge is positioned inside the discharge cells partitioned by the barrier ribs 122. The phosphor 124 may include red (R), green (G) and blue (B) phosphors.

The plasma display panel according to the exemplary embodiment is discharged by applying driving signals to the scan electrode 112, the sustain electrode 113 and the address electrode 123, thereby displaying an image inside the discharge cells.

Since FIG. 2 illustrated only an example of the plasma display panel applicable to the exemplary embodiment, the exemplary embodiment is not limited thereto.

Figure 3:
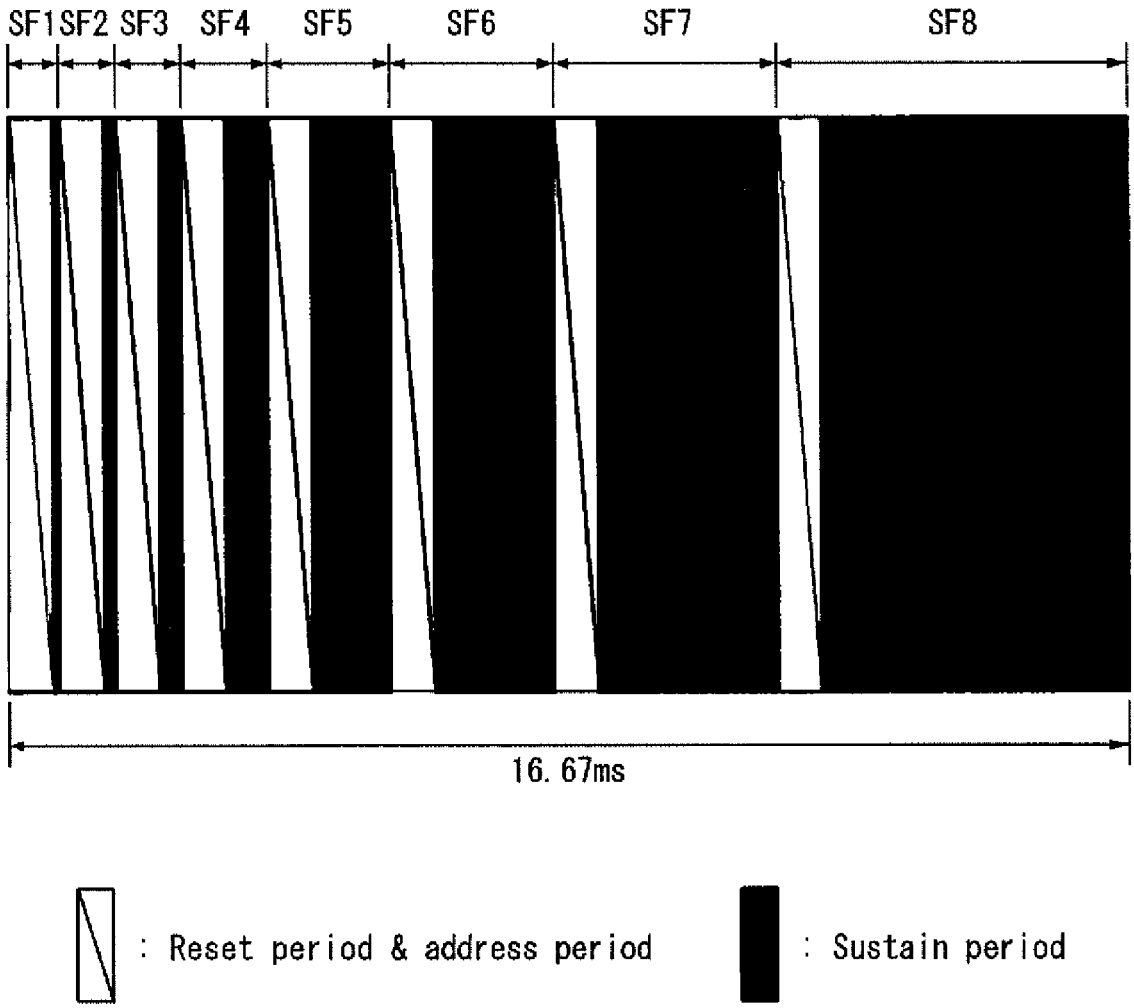
FIG. 3 illustrates a frame for achieving a gray scale of an image in the plasma display apparatus according to the exemplary embodiment.

FIG. 3 illustrates a frame for achieving a gray scale of an image in the plasma display apparatus according to the exemplary embodiment.

As illustrated in FIG. 3, a frame for achieving a gray scale of an image in the plasma display apparatus according to the exemplary embodiment is divided into a plurality of subfields each having a different number of emission times.

Each subfields may be subdivided into a reset period for initializing all the discharge cells, an address period for selecting cells to be discharged, and a sustain period for representing a gray scale in accordance with the number of discharges.

For instance, if an image with 256-level gray scale is to be displayed, a frame period (i.e., 16.67 ms) corresponding to 1/60 second, as shown in FIG. 3, is divided into 8 subfields SF1 to SF8. Each of the 8 subfields SF1 to SF8 is subdivided into a reset period, an address period, and a sustain period.

The number of sustain signals supplied during the sustain period determines gray level weight in each subfield. In other words, predetermined gray level weight is assigned to each subfield using a time width of the sustain period. For instance, in such a method of setting gray level weight of a first subfield to $2^0$ and gray level weight of a second subfield to $2^1$, a time width of the sustain period increases in a ratio of $2^n$ (where, n=0, 1, 2, 3, 4, 5, 6, 7) in each of the subfields. An image with various gray levels can be displayed by controlling the number of sustain signals supplied during the sustain period of each subfield depending on gray level weight in each subfield.

The plasma display apparatus according to the exemplary embodiment uses a plurality of frames to display an image for 1 second. For instance, 60 frames are used to display an image for 1 second.

While one frame includes 8 subfields in FIG. 3, the number of subfields constituting one frame may variously change. For instance, one frame may include 12 subfields or 10 subfields.

The image quality in the plasma display apparatus depends on the number of subfields included in a frame. For instance, when one frame includes 12 subfields, gray scale having $2^{12}$ values can be achieved. When one frame includes 10 subfields, gray scale having $2^{10}$ values can be achieved.

Further, while the subfields are arranged in increasing order of gray level weight in FIG. 3, the subfields may be arranged in decreasing order of gray level weight. The subfields may be arranged regardless of gray level weight so as to prevent a contour noise generated when an image is displayed.

Figure 4:
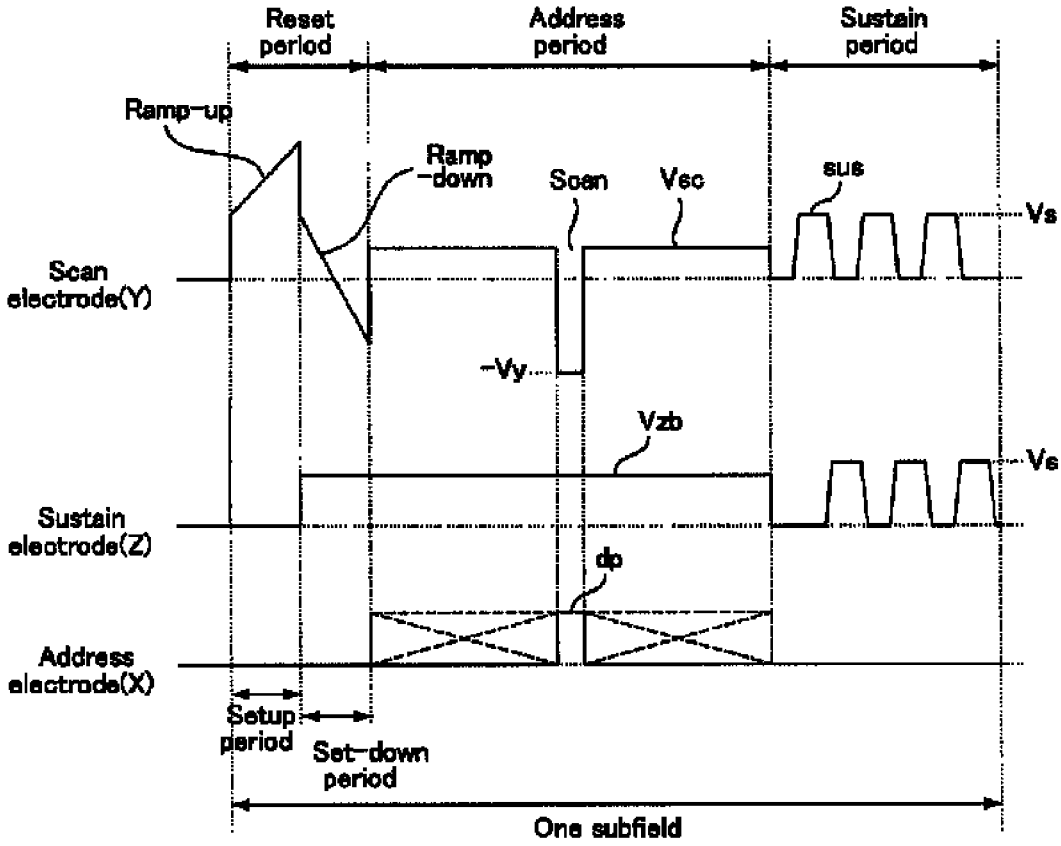
FIG. 4 is a diagram for explaining an operation of the plasma display apparatus according to the exemplary embodiment.

FIG. 4 is a diagram for explaining an operation of the plasma display apparatus according to the exemplary embodiment in any one of the plurality of subfields of FIG. 3. As shown in FIG. 4, the first driver 200, the second driver 300 and the third driver 400 of FIG. 1 may supply driving signals to the scan electrode Y, the sustain electrode Z and the address electrode X during at least one of a reset period, an address period, and a sustain period.

The reset period is divided into a setup period and a set-down period. During the setup period, the first driver 200 may supply a rising signal (Ramp-up) to the scan electrode Y. The rising signal (Ramp-up) generates a weak dark discharge inside the discharge cells of the whole screen. Hence, wall charges of a positive polarity are accumulated on the sustain electrode Z and the address electrode X, and wall charges of a negative polarity are accumulated on the scan electrode Y.

During the set-down period, the first driver 200 may supply a falling signal (Ramp-down), which falls from a positive voltage level lower than a highest voltage of the rising signal (Ramp-up) to a given voltage level lower than a ground level voltage GND, to the scan electrode Y, thereby generating a weak erase discharge inside the discharge cells. Hence, wall charges excessively accumulated inside the discharge cells are erased, and the remaining wall charges are uniformly distributed inside the discharge cells to the extent that an address discharge can stably occur.

The second driver 300 supplies a sustain bias voltage Vzb to the sustain electrode Z during the set-down period and the address period. The sustain bias voltage Vzb reduces a voltage difference between the sustain electrode Z and the scan electrode Y, thereby preventing the generation of an erroneous discharge.

The first driver 200 supplies a scan signal (Scan) of a negative polarity falling from a scan bias voltage Vsc to the scan electrode Y during the address period.

The first driver 200 may supply a scan signal having a different voltage magnitude in each subfield. The first driver 200 may supply a scan signal having a different voltage magnitude to each of a plurality of scan electrode groups each including at least one scan electrode. A driving margin can be improved by supplying the scan signal having the different voltage magnitude depending on a temperature of the plasma display panel. Hence, an erroneous discharge can be prevented.

A lowest voltage of the scan signal (Scan) may be lower than a lowest voltage of the falling signal (Ramp-down). Hence, a highest voltage of a data signal can be reduced.

The third driver 400 supplies a data signal (dp) of a positive polarity corresponding to the scan signal (Scan) to the address electrode X. The third driver 400 may include two drivers, and thus the two drivers may the data signal (dp) to the address electrode X. The two drivers may supply a data signal having a different voltage magnitude to each of a plurality of address electrode groups each including at least one address electrode. The third driver 400 (or the two drivers) may supply a data signal having a different voltage magnitude during an address period of each subfield. A loss of wall charges can be prevented by supplying the data signal having the different voltage magnitude. Hence, a voltage margin of an address discharge and a sustain margin can increase.

As a voltage difference between the scan signal (Scan) and the data signal (dp) is added to a wall voltage produced during the reset period, an address discharge occurs inside the discharge cells to which the data signal (dp) is applied. Wall charges are accumulated inside the discharge cells selected by performing the address discharge to the extent that when a sustain voltage Vs is applied, a discharge occurs.

During the sustain period, the first driver 200 and the second driver 300 supply sustain signals (sus) to the scan electrode Y and the sustain electrode Z, respectively. As a wall voltage inside the discharge cells selected by performing the address discharge is added to the sustain signal (sus), every time the sustain signal (sus) is applied, a sustain discharge occurs between the scan electrode Y and the sustain electrode Z.

An erase period during which the remaining wall charges after the sustain discharge are erased may be added after the sustain period. Further, a pre-reset period during which wall charges are stably distributed may be added prior to the reset period.

Although the first driver 200 and the second driver 300 operate independently of each other in FIG. 4, the first driver 200 and the second driver 300 may operate in the form of an integrated driver.

Figure 5:
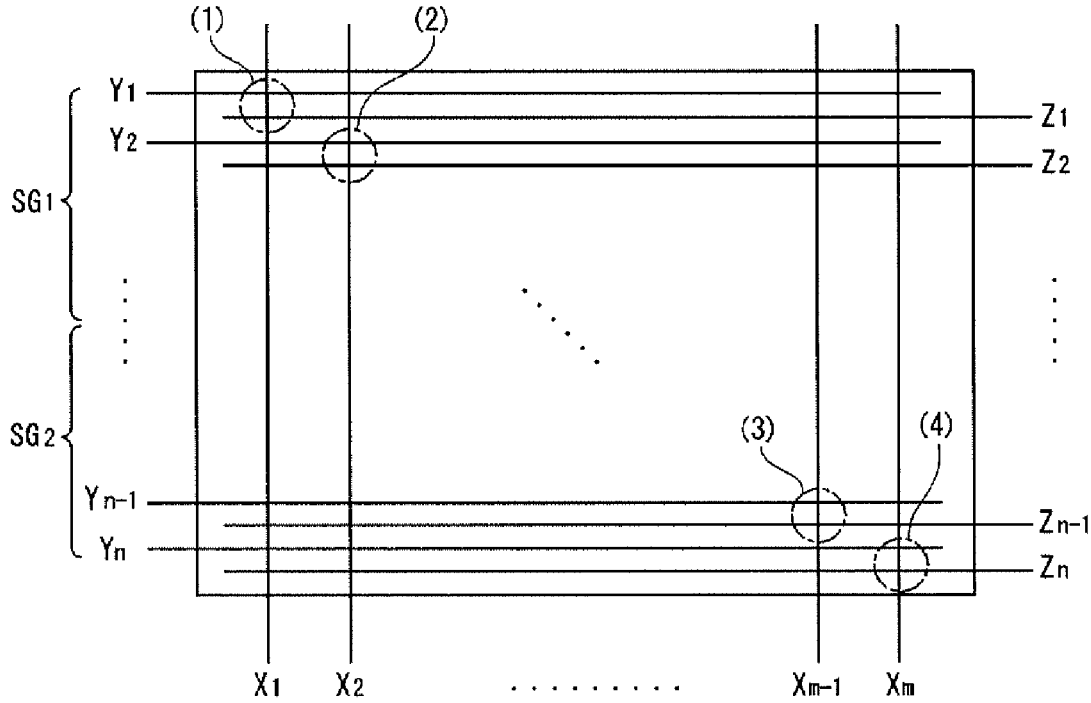
FIG. 5 is a diagram for explaining a first implementation of a method of driving the plasma display apparatus according to the exemplary embodiment.
Figure 5:
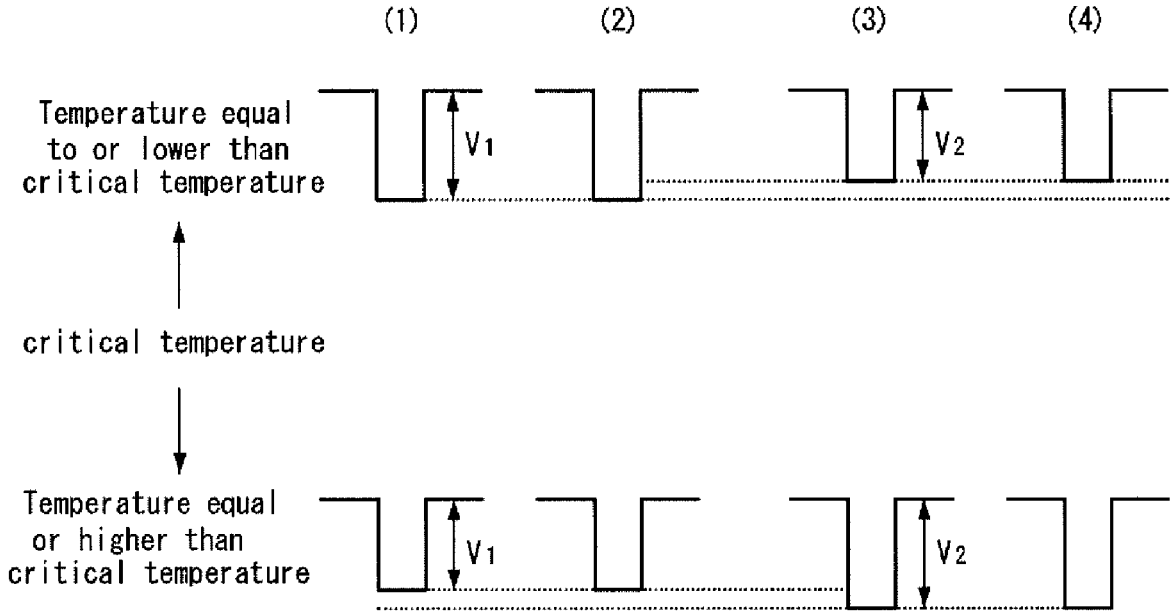

FIG. 5 is a diagram for explaining a first implementation of a method of driving the plasma display apparatus according to the exemplary embodiment.

In FIG. 5, (1), (2), (3) and (4) are enlarged views of a scan signal supplied during an address period depending on the scanning order.

The plurality of scan electrodes Y1 to Yn may be divided into a plurality of scan electrode groups each including at least one scan electrode depending on characteristics of the panel. In FIG. 5, the plurality of scan electrodes Y1 to Yn are divided into two scan electrode groups SG1 and SG2 for the easier explanation. The first and second scan electrode groups SG1 and SG2 are sequentially positioned.

A first scan signal is supplied to the first scan electrode group SG1, and a second scan signal is supplied to the second scan electrode group SG2.

A voltage magnitude V1 of the first scan signal is different from a voltage magnitude V2 of the second scan signal. The difference occurs because of a relationship between wall charges on the electrodes and space charges inside the discharge cells. A voltage magnitude of the scan signal may change depending on a rate of a recombination between the wall charges and the space charges.

A critical temperature of the plasma display panel may be measured at any one position of several positions of the plasma display panel (e.g., the inside, the outside, the side, and the rear of the plasma display panel) using various methods. In the exemplary embodiment, a critical temperature of the plasma display panel is referred to as a temperature measured outside the plasma display panel. In the exemplary embodiment, a critical temperature of the plasma display panel is 50° C.

When a temperature of the panel is equal to or higher than the critical temperature, a rate of a recombination between the wall charges and the space charges increases. Hence, the amount of wall charges participating to a discharge decreases, and thus the discharge does not occur inside the discharge cells in which the discharge has to occur. The space charges existing inside the discharge cells do not participate to a discharge.

Because the amount of wall charges participating to an address discharge decreases when a rate of a recombination between the wall charges and the space charges increases during an address period, the address discharge is unstable. Further, because enough time to perform a recombination between the wall charges and the space charges is secured as the address period elapses, the address discharge is more unstable.

Accordingly, a sum of a voltage magnitude of the scan signal and a voltage magnitude of the data signal has to increase as the address period elapses, so as to stably generate an address discharge. Since the data signal had an equal voltage magnitude throughout the address period, a voltage magnitude of the scan signal increases as the address period elapses. For instance, the voltage magnitude V1 of the first scan signal supplied to the first scan electrode group SG1 is smaller than the voltage magnitude V2 of the second scan signal supplied to the second scan electrode group SG2.

The voltage magnitude of the scan signal is referred to as a voltage magnitude ranging from the scan bias voltage Vsc to a lowest voltage of the scan signal. The voltage magnitude of the data signal is referred to as a voltage magnitude ranging from a ground level voltage to a highest voltage of the data signal.

When a temperature of the panel is equal to or lower than the critical temperature, a rate of a recombination between the wall charges and the space charges decreases. Hence, the amount of wall charges participating to a discharge increases, and thus a discharge occurs inside the discharge cells in which the discharge does not have to occur.

Because the amount of wall charges participating to an address discharge increases when a rate of a recombination between the wall charges and the space charges decreases during an address period, the address discharge is unstable. Further, because the moving amount of the space charges and the wall charges decreases and also a rate of a recombination between the wall charges and the space charges further decreases at a relatively low temperature as the address period elapses, the amount of wall charges excessively increases. Therefore, the address discharge is more unstable.

Accordingly, a sum of a voltage magnitude of the scan signal and a voltage magnitude of the data signal has to decrease as the address period elapses, so as to stably generate an address discharge. Since the data signal has an equal voltage magnitude throughout the address period, a voltage magnitude of the scan signal is reduced as the address period elapses. For instance, the voltage magnitude V1 of the first scan signal supplied to the first scan electrode group SG1 is larger than the voltage magnitude V2 of the second scan signal supplied to the second scan electrode group SG2.

While FIG. 5 has illustrated and described changes in the voltage magnitude of the scan signal, changes in the voltage magnitude of the data signal will be now described.

Figure 6A:
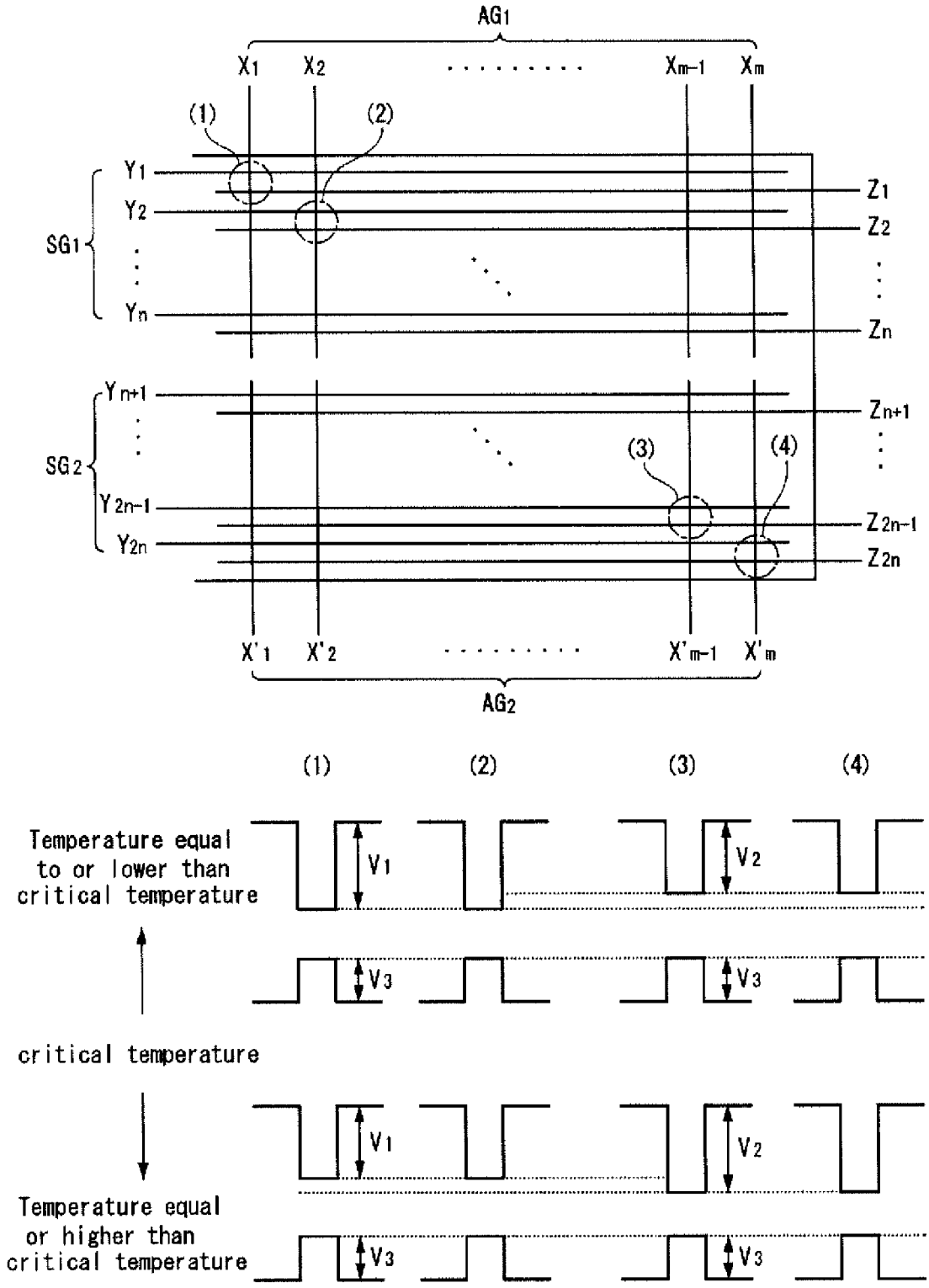
FIGS. 6A and 6B are diagrams for explaining a second implementation of a method of driving the plasma display apparatus according to the exemplary embodiment.
Figure 6B:
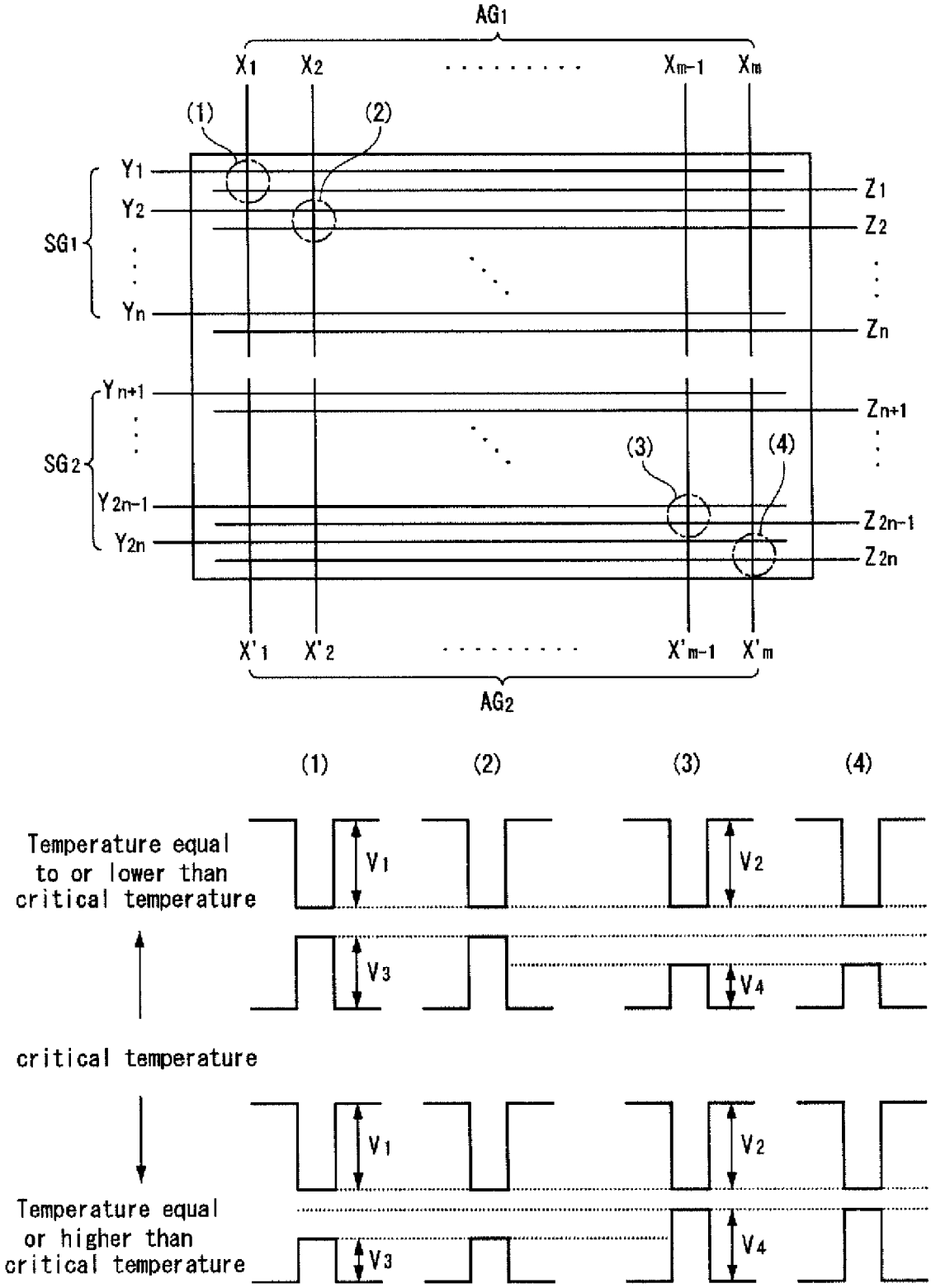

FIGS. 6A and 6B are diagrams for explaining a second implementation of a method of driving the plasma display apparatus according to the exemplary embodiment.

In FIGS. 6A and 6B, (1), (2), (3) and (4) are enlarged views of a scan signal supplied to the scan electrode depending on scanning order and a data signal corresponding to the scan signal during an address period. In FIGS. 6A and 6B, a plurality of scan electrodes $Y_1$, to $Y_{2n}$ are divided into a first scan electrode group SG1 including the scan electrodes Y1 to Yn and a second scan electrode group SG2 including the scan electrodes $Y_{(n+1)}$ to $Y_{2n}$, and a plurality of address electrodes X1 to Xm and X'1 to X'm are divided into a first address electrode group AG1 including the address electrodes X1 to Xm and a second address electrode group AG2 including the address electrodes X'1 to X'm.

The third driver supplying the data signal may include a driver supplying a first data signal and a driver supplying a second data signal. The two drivers may sequentially supply the first data signal and the second data signal to the address electrodes, respectively, or may simultaneously supply the first data signal and the second data signal to the address electrodes, respectively.

A sum of a voltage magnitude V1 of a first scan signal supplied to the first scan electrode group SG1 and a voltage magnitude V3 of a first data signal supplied to the first address electrode group AG1 is different from a sum of a voltage magnitude V2 of a second scan signal supplied to the second scan electrode group SG2 and a voltage magnitude V4 of a second data signal supplied to the second address electrode group AG2.

The difference occurs because of a relationship between wall charges on the electrodes and space charges inside the discharge cells. A voltage magnitude of the scan signal and a voltage magnitude of the data signal may change depending on a rate of a recombination between the wall charges and the space charges.

The difference may occur when the voltage magnitude V3 of the first data signal is approximately equal to the voltage magnitude V4 of the second data signal, and the voltage magnitude V1 of the first scan signal is different from the voltage magnitude V2 of the second scan signal. Further, the difference may occur when the voltage magnitude V1 of the first scan signal is approximately equal to the voltage magnitude V2 of the second scan signal, and the voltage magnitude V3 of the first data signal is different from the voltage magnitude V4 of the second data signal.

Since a method, in which the voltage magnitude V3 is approximately equal to the voltage magnitude V4 and the voltage magnitude V1 is different from the voltage magnitude V2, was already described in FIG. 5, the description thereof is omitted in FIG. 6A.

FIG. 6B illustrates a method, in which the voltage magnitude V1 is approximately equal to the voltage magnitude V2 and the voltage magnitude V3 is different from the voltage magnitude V4. Therefore, the voltage magnitude V1 of the first scan signal is approximately equal to the voltage magnitude V2 of the second scan signal.

A sum of the voltage magnitude V1 and the voltage magnitude V3 may be smaller than a sum of the voltage magnitude V2 and the voltage magnitude V4. The voltage magnitude V3 of the first data signal may be smaller than the voltage magnitude V4 of the second data signal. The reason why a voltage magnitude of the data signal increases as an address period elapses is that a temperature of the plasma display panel is equal to or higher than the critical temperature.

A rate of a recombination between the wall charges and the space charges increases during the address period at a panel temperature equal to or higher than the critical temperature, and thus the amount of wall charges participating to an address discharge decreases. Hence, the address discharge is unstable. Further, because enough time to perform a recombination between the wall charges and the space charges is secured as the address period elapses, the address discharge is more unstable.

Accordingly, a sum of the voltage magnitudes V1 and V2 of the scan signal and the voltage magnitudes V3 and V4 of the data signal increases as the address period elapses, so as to stably generate an address discharge. Since the voltage magnitudes V1 and V2 of the scan signal are substantially equal to each other, the voltage magnitudes V3 and V4 of the data signal increases as the address period elapses. For instance, the voltage magnitude V3 of the first data signal supplied to the first address electrode group AG1 is smaller than the voltage magnitude V4 of the second data signal supplied to the second address electrode group AG2.

A sum of the voltage magnitude V1 and the voltage magnitude V3 may be larger than a sum of the voltage magnitude V2 and the voltage magnitude V4. The voltage magnitude V3 of the first data signal may be larger than the voltage magnitude V4 of the second data signal. The reason why a voltage magnitude of the data signal decreases as an address period elapses is that a temperature of the plasma display panel is equal to or lower than the critical temperature.

A rate of a recombination between the wall charges and the space charges decreases during the address period at a panel temperature equal to or lower than the critical temperature, and thus the amount of wall charges participating to an address discharge increases. Hence, the address discharge is unstable. Further, because the moving amount of the space charges and the wall charges decreases and also a rate of a recombination between the wall charges and the space charges further decreases at a relatively low temperature as the address period elapses, the amount of wall charges excessively increases. Hence, the address discharge is more unstable.

Accordingly, a sum of the voltage magnitudes V1 and V2 of the scan signal and the voltage magnitudes V3 and V5 of the data signal decreases as the address period elapses, so as to stably generate an address discharge. Since the voltage magnitudes V1 and V2 of the scan signal are substantially equal to each other, the voltage magnitudes V3 and V4 of the data signal decreases as the address period elapses. For instance, the voltage magnitude V3 of the first data signal supplied to the first address electrode group AG1 is larger than the voltage magnitude V4 of the second data signal supplied to the second address electrode group AG2.

The driving method in which the scan signals having the different voltage magnitudes are supplied to the scan electrode groups, or the driving method in which the data signals having the different voltage magnitudes are supplied to the address electrode groups was described above. A driving method in which scan signals having different voltage magnitudes or data signals having different voltage magnitudes are supplied in each subfield will be described below.

Figure 7:
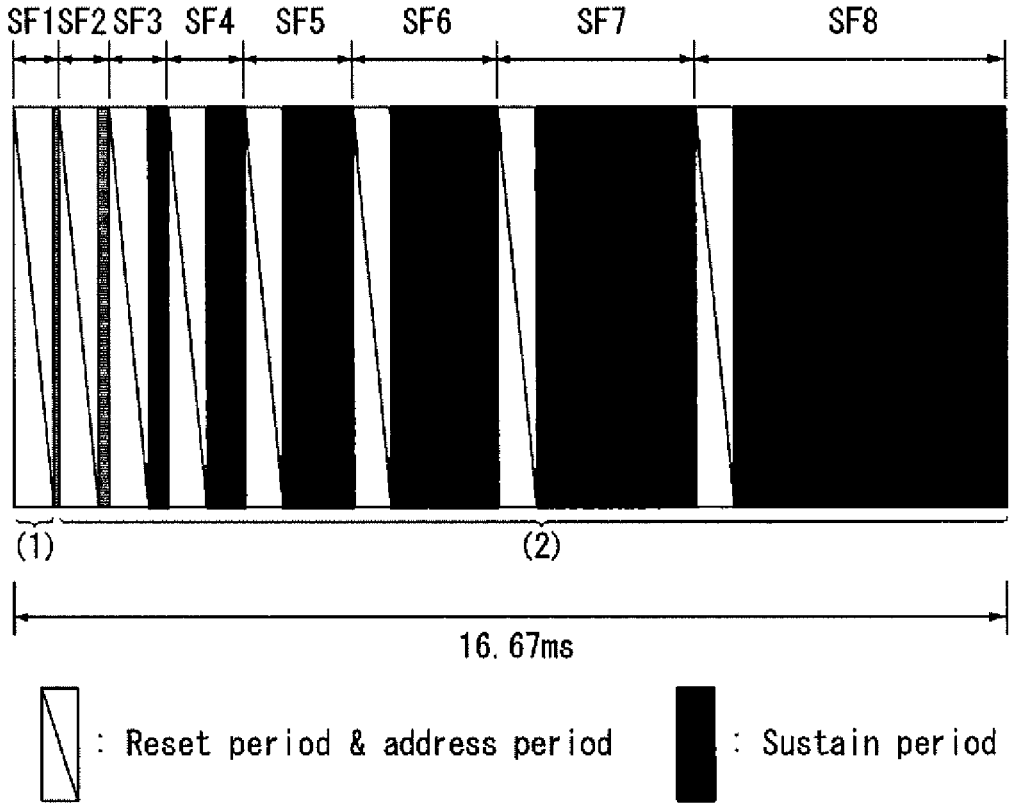
FIG. 7 is a diagram for explaining a third implementation of a method of driving the plasma display apparatus according to the exemplary embodiment.
Figure 7:
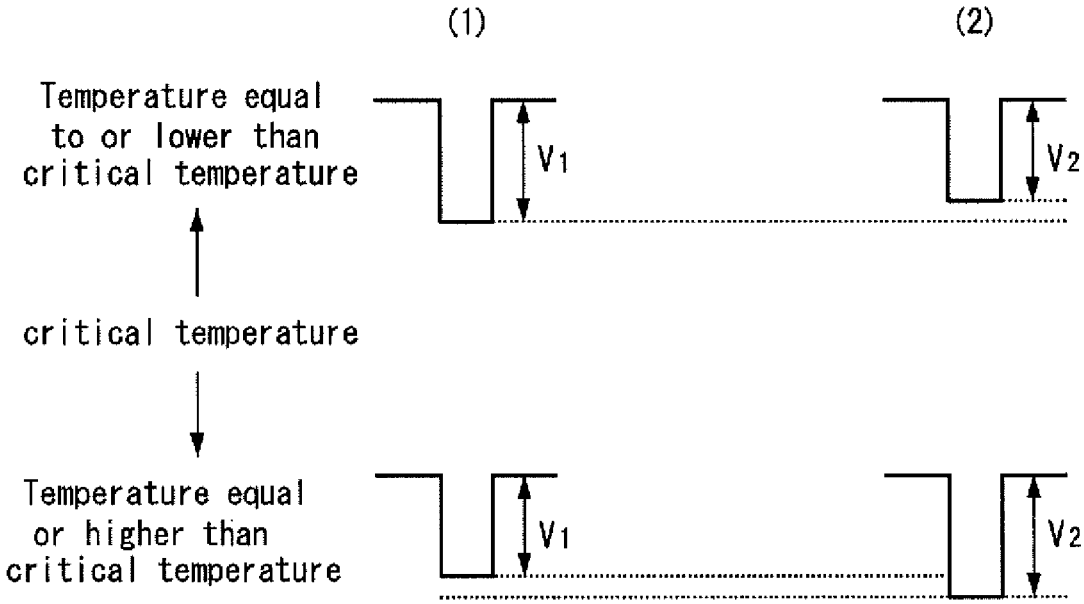

FIG. 7 is a diagram for explaining a third implementation of a method of driving the plasma display apparatus according to the exemplary embodiment.

In FIG. 7, (1) is an enlarged view of a first scan signal supplied to the scan electrode during an address period of a predetermined subfield, and (2) is an enlarged view of a second scan signal supplied to the scan electrode during address periods of the other subfields except the predetermined subfield.

Since the description of subfields was sufficiently described in FIG. 3, it is omitted in FIG. 7. The same description as that of FIGS. 5, 6A and 6B is omitted in FIG. 7.

A first scan signal is supplied to the scan electrode during an address period of a first subfield of one frame, and a second scan signal is supplied to the scan electrode during address periods of the other subfields except the first subfield. This is because a relationship between wall charges on the electrodes and space charges inside the discharge cells. A voltage magnitude of the first scan signal and a voltage magnitude of the second scan signal may change depending on a rate of recombination between the wall charges and the space charges.

A rate of a recombination between the wall charges and the space charges increases during the address period at a panel temperature equal to or higher than the critical temperature, and thus the amount of wall charges participating to an address discharge decreases. Hence, the address discharge is unstable. Further, because enough time to perform a recombination between the wall charges and the space charges is secured as the address period elapses, the address discharge is more unstable.

Accordingly, a voltage magnitude V1 of the first scan signal supplied during the address period of the first subfield of one frame is smaller than a voltage magnitude V2 of the second scan signal supplied during the address periods of the other subfields except the first subfield, so as to stably generate the address discharge.

A rate of a recombination between the wall charges and the space charges decreases during the address period at a panel temperature equal to or lower than the critical temperature, and thus the amount of wall charges participating to an address discharge increases. Hence, the address discharge is unstable. Further, because the moving amount of the space charges and the wall charges decreases and also a rate of a recombination between the wall charges and the space charges further decreases at a relatively low temperature as the address period elapses, the amount of wall charges excessively increases. Hence, the address discharge is more unstable.

Accordingly, the voltage magnitude V1 of the first scan signal supplied during the address period of the first subfield of one frame is larger than the voltage magnitude V2 of the second scan signal supplied during the address periods of the other subfields except the first subfield, so as to stably generate the address discharge.

The driving method in which the scan signals having the different voltage magnitudes are supplied in each subfield was described in FIG. 7. A driving method in which data signals having different voltage magnitudes are supplied in each subfield will be described in FIG. 8.

Figure 8:
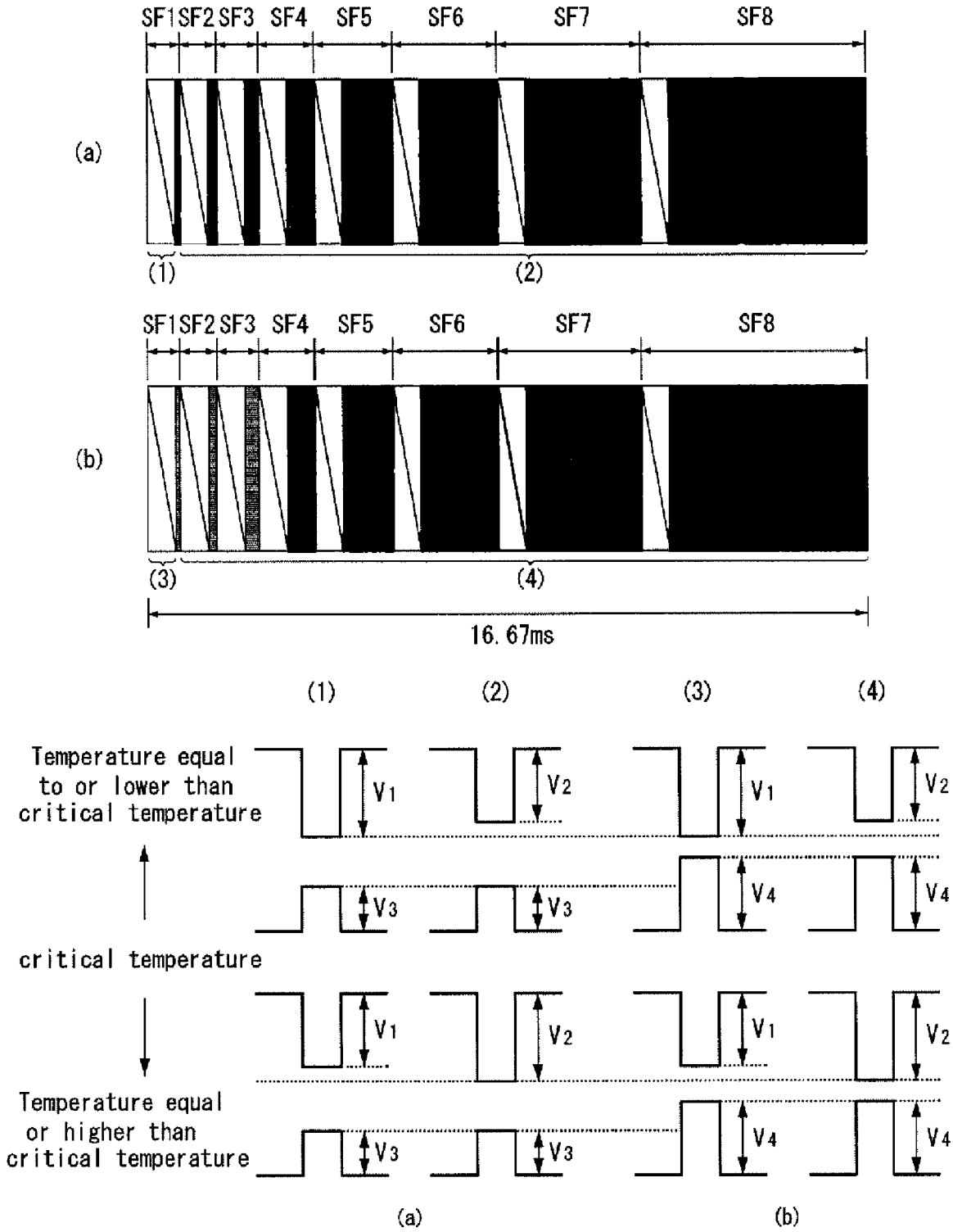
FIG. 8 is a diagram for explaining a fourth implementation of a method of driving the plasma display apparatus according to the exemplary embodiment.

FIG. 8 is a diagram for explaining a fourth implementation of a method of driving the plasma display apparatus according to the exemplary embodiment.

In FIG. 8, (1) is an enlarged view of a first scan signal supplied to the scan electrode and a first data signal corresponding to the first scan signal supplied to the address electrode during an address period of a predetermined subfield; (2) is an enlarged view of a second scan signal supplied to the scan electrode and the first data signal corresponding to the second scan signal supplied to the address electrode during address periods of the other subfields except the predetermined subfield; (3) is an enlarged view of the first scan signal supplied to the scan electrode and a second data signal corresponding to the first scan signal supplied to the address electrode during the address period of the predetermined subfield; and (4) is an enlarged view of the second scan signal supplied to the scan electrode and the second data signal corresponding to the second scan signal supplied to the address electrode during the address periods of the other subfields except the predetermined subfield.

Although it is not shown in FIG. 8, the supply of the data signal may be achieved due to the supply of data signals having different voltage magnitudes in each subfield.

The third driver supplying the data signal may include a driver (refer to (a) of FIG. 8) supplying the first data signal and a driver (refer to (b) of FIG. 8) supplying the second data signal. The two drivers may sequentially supply the first data signal and the second data signal to the address electrodes, respectively, or may simultaneously supply the first data signal and the second data signal to the address electrodes, respectively.

A sum of a voltage magnitude V1 of a first scan signal and a voltage magnitude V3 of a first data signal is smaller than a sum of a voltage magnitude V2 of a second scan signal and a voltage magnitude V4 of a second data signal at a temperature equal to or higher than the critical temperature. A sum of the voltage magnitude V2 of the second scan signal and the voltage magnitude V3 of the first data signal is larger than the voltage magnitude V1 of the first scan signal and the voltage magnitude V4 of the second data signal at the temperature equal to or higher than the critical temperature. This reason is that the voltage magnitude V1 of the first scan signal is smaller than the voltage magnitude V2 of the second scan signal and the voltage magnitude V3 of the first data signal is smaller than the voltage magnitude V4 of the second data signal.

A sum of the voltage magnitude V1 of the first scan signal and the voltage magnitude V3 of the first data signal is larger than a sum of the voltage magnitude V2 of the second scan signal and the voltage magnitude V4 of the second data signal at a temperature equal to or lower than the critical temperature. A sum of the voltage magnitude V2 of the second scan signal and the voltage magnitude V3 of the first data signal is smaller than the voltage magnitude V1 of the first scan signal and the voltage magnitude V4 of the second data signal at the temperature equal to or lower than the critical temperature. This reason is that the voltage magnitude V1 of the first scan signal is larger than the voltage magnitude V2 of the second scan signal and the voltage magnitude V3 of the first data signal is smaller than the voltage magnitude V4 of the second data signal. Since an effect and an advantage obtained by a difference between the voltage magnitudes V1 and V2 and a difference between the voltage magnitudes V3 and V4 were described in FIGS. 5 to 7, the description is omitted in FIG. 8.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method of driving a plasma display apparatus comprising:

supplying a first scan signal to a first scan electrode group of a plurality of scan electrode groups each including at least one scan electrode during an address period;

supplying a second scan signal having a different voltage magnitude from a voltage magnitude of the first scan signal to a second scan electrode group of the plurality of scan electrode groups during the address period; and supplying a data signal corresponding to the first scan signal and the second scan signal to an address electrode, wherein the first scan signal or the second scan signal is supplied depending on scanning order of the plurality of scan electrodes during the address period, wherein when a temperature of the plasma display panel is higher than a critical temperature, the voltage magnitude of the first scan signal is smaller than the voltage magnitude of the second scan signal, wherein when a temperature of the plasma display panel is lower than a critical temperature, the voltage magnitude of the first scan signal is larger than the voltage magnitude of the second scan signal, and the first scan signal is applied prior to the second scan signal.

2. The method of claim 1, wherein the critical temperature is 50° C.

3. A method of driving a plasma display apparatus comprising:

supplying a first scan signal to a first scan electrode group of a plurality of scan electrode groups each including at least one scan electrode during an address period;

supplying a second scan signal to a second scan electrode group of the plurality of scan electrode groups during the address period;

supplying a first data signal corresponding to the first scan signal to a first address electrode group corresponding to the first scan electrode group during the address period; and supplying a second data signal corresponding to the second scan signal to a second address electrode group corresponding to the second scan electrode group during the address period, wherein a sum of a voltage magnitude of the first scan signal and a voltage magnitude of the first data signal is different from a sum of a voltage magnitude of the second scan signal and a voltage magnitude of the second data signal, wherein when a temperature of the plasma display panel is higher than a critical temperature, the sum of the voltage magnitude of the first scan signal and the voltage magnitude of the first data signal is larger than the sum of the voltage magnitude of the second scan signal and the voltage magnitude of the second scan signal, wherein when a temperature of the plasma display panel is lower than a critical temperature, the sum of the voltage magnitude of the first scan signal and the voltage magnitude of the first data signal is smaller than the sum of the voltage magnitude of the second scan signal and the voltage magnitude of the second data signal, and the first scan signal is applied prior to the second scan signal.

4. The method of claim 3, wherein the first scan signal or the second scan signal is supplied depending on scanning order of the plurality of scan electrodes during the address period.

5. The method of claim 3, wherein when a temperature of the plasma display panel is equal to or higher than a critical temperature, a temperature of the plasma display panel is equal to or higher than a critical temperature, the voltage magnitude of the first scan signal is smaller than the voltage magnitude of the second scan signal.

6. The method of claim 3, the voltage magnitude of the first scan signal is larger than the voltage magnitude of the second scan signal.

7. The method of claim 3, wherein the critical temperature is 50° C.

8. The method of claim 3, wherein the voltage magnitude of the first scan signal is substantially equal to the voltage magnitude of the second scan signal.

9. The method of claim 3, wherein the voltage magnitude of the first data signal is smaller than the voltage magnitude of the second data signal.

10. The method of claim 3, wherein the voltage magnitude of the first data signal is larger than the voltage magnitude of the second data signal.

11. The method of claim 3, wherein the voltage magnitude of the first data signal is substantially equal to the voltage magnitude of the second data signal.

12. The method of claim 3, wherein when a temperature of the plasma display panel is higher than a critical temperature, the voltage magnitude of the first data signal is larger than the voltage magnitude of the second signal and, when the temperature of the plasma display panel is lower than a critical temperature, the voltage magnitude of the first data signal is smaller than the voltage magnitude of the second data signal.

13. A method of driving a plasma display apparatus comprising:

supplying a first scan signal to a scan electrode during an address period of a first subfield of a plurality of subfields of one frame;

supplying a second scan signal to the scan electrode during an address period of a second subfield of the plurality of subfields;

supplying a first data signal corresponding to the first scan signal supplied during the address period of the first subfield or corresponding to the second scan signal supplied during the address period of the second subfield to a first address electrode group of a plurality of address electrode groups each including at least one address electrode; and supplying a second data signal corresponding to the first scan signal supplied during the address period of the first subfield or corresponding to the second scan signal supplied during the address period of the second subfield to a second address electrode group of the plurality of address electrode groups, wherein a sum of a voltage magnitude of the first scan signal and a voltage magnitude of the first data signal is different from a sum of a voltage magnitude of the second scan signal and a voltage magnitude of the second data signal, and a sum of the voltage magnitude of the second scan signal and the voltage magnitude of the first data signal is different from a sum of the voltage magnitude of the first scan signal and the voltage magnitude of the second data signal, wherein when a temperature of the plasma display panel is higher than a critical temperature, the voltage magnitude of the first scan signal is smaller than the voltage magnitude of the second scan signal, wherein when a temperature of the plasma display panel is lower than a critical temperature, the voltage magnitude of the first scan signal is larger than the voltage magnitude of the second scan signal, and the first scan signal is applied prior to the second scan signal.

14. The method of claim 13, wherein the sum of the voltage magnitude of the first scan signal and the voltage magnitude of the first data signal is smaller than the sum of the voltage magnitude of the second scan signal and the voltage magnitude of the second data signal.

15. The method of claim 13, wherein the sum of the voltage magnitude of the first scan signal and the voltage magnitude of the first data signal is larger than the sum of the voltage magnitude of the second scan signal and the voltage magnitude of the second data signal.

16. The method of claim 13, wherein the sum of the voltage magnitude of the second scan signal and the voltage magnitude of the first data signal is larger than the sum of the voltage magnitude of the first scan signal and the voltage magnitude of the second data signal.

17. The method of claim 13, wherein the sum of the voltage magnitude of the second scan signal and the voltage magnitude of the first data signal is smaller than the sum of the voltage magnitude of the first scan signal and the voltage magnitude of the second data signal.

18. The method of claim 13, wherein the critical temperature is 50° C.

19. The method of claim 13, wherein the voltage magnitude of the first scan signal is substantially equal to the voltage magnitude of the second scan signal.

20. The method of claim 13, wherein the voltage magnitude of the first data signal is smaller than the voltage magnitude of the second data signal.

21. The method of claim 13, wherein the voltage magnitude of the first data signal is larger than the voltage magnitude of the second data signal.

22. The method of claim 13, wherein the voltage magnitude of the first data signal is substantially equal to the voltage magnitude of the second data signal.

23. The method of claim 13, wherein the first subfield has the lowest gray level weight in the one frame and the second subfield is the other consisting of the one frame except the first subfield.

24. A method of driving a plasma display apparatus comprising:

during an address period, supplying a first scan signal to a first scan electrode group within a plurality of scan electrode groups each including at least one scan electrode, and supplying a second scan signal having a different voltage magnitude from a voltage magnitude of the first scan signal to a second scan electrode group within the plurality of scan electrode groups; and supplying a data signal corresponding to the first scan signal and the second scan signal to an address electrode, accessing a temperature of the plasma display panel;

comparing the temperature of the plasma display panel to a critical temperature;

in response to a determination that the temperature of the plasma display panel is higher than a critical temperature, adjusting the relative voltage magnitudes of the first and second scan signals such that the voltage magnitude of the first scan signal is smaller than the voltage magnitude of the second scan signal.

* * * * *